US005615714A

United States Patent [19]

Bortoli et al.

[11] Patent Number: 5,615,714

[45] Date of Patent: Apr. 1, 1997

[54] GUIDE SYSTEM FOR THE GRIPPER INSERTION TAPE IN A SHUTTLELESS LOOM

[75] Inventors: Giulio Bortoli, Schio; Luciano Corain; Gianluigi Sora, both of Vicenza, all of Italy

[73] Assignee: Nuovo Pignone S.p.A., Florence, Italy

[21] Appl. No.: 443,314

[22] Filed: May 17, 1995

[30] Foreign Application Priority Data

May 27, 1994 [IT] Italy ..... MI94A1086

[51] Int. Cl.[6] ..... D03D 47/27

[52] U.S. Cl. ..... 139/449

[58] Field of Search ..... 139/449

[56] References Cited

U.S. PATENT DOCUMENTS

| | | | |
|---|---|---|---|
| 4,083,506 | 4/1978 | Mander et al. | 242/25 R |
| 4,638,839 | 1/1987 | Pezzoli | 139/449 |
| 5,135,033 | 8/1992 | Stacher et al. | 139/449 |
| 5,176,185 | 1/1993 | Rheinganz et al. | 139/449 |

FOREIGN PATENT DOCUMENTS

| | | | |
|---|---|---|---|
| 0199880 | 11/1986 | European Pat. Off. | 139/449 |
| 0446424 | 9/1991 | European Pat. Off. . | |
| 0446561 | 9/1991 | European Pat. Off. . | |
| 0468916 | 1/1992 | European Pat. Off. . | |
| 2439802 | 4/1975 | Germany | 139/449 |
| 9410364 | 5/1994 | WIPO | 139/449 |

*Primary Examiner*—Andy Falik

*Attorney, Agent, or Firm*—Oblon, Spivak, McClelland, Maier & Neustadt, P.C.

[57] ABSTRACT

A guide system for a gripper insertion tape in a shuttleless loom which includes a sley with a reed, through the dents of which pass upper and lower warp yarns forming a shed, at least one insertion tape moving with reciprocating motion between the upper and lower warp yarns of the open shed, a gripper fixed to one end of the tape to convey a weft yarn through the shed, and a plurality of guide teeth fixed spaced apart on the sley and projecting through the lower warp yarns of the shed when the shed is open. The teeth are provided with a bearing and guiding surface for the insertion tape and for the gripper. The bearing and guiding surface of the teeth includes a convex surface which extends in the direction of the warp yarns. A control mechanism is also provided making guiding of the insertion tape and the gripper more effective during travel thereof within the shed.

6 Claims, 4 Drawing Sheets

GUIDE SYSTEM FOR THE GRIPPER INSERTION TAPE IN A SHUTTLELESS LOOM

BACKGROUND OF THE INVENTION

1. Field of the Invention

This invention relates to a novel guide system for the gripper drive tape in a shuttleless loom which enables the sley to move even when said tape is still cooperating with its guide mounted on said sley, without affecting the guiding conditions and while still ensuring self-positioning of the lower warp yarns of the shed and effective guiding of said tape within said shed, so as to enable a higher operating rate and productivity to be obtained from the loom and the possibility of constructing looms of greater weaving width.

2. Discussion of the Background

As is well known, in shuttleless looms, a giver gripper, starting from one side of the loom, generally inserts the weft yarn into the open shed formed by the warp yarns, until it transfers it to a taker gripper which carries it outside said shed on the opposite side of the loom. Said two grippers are each driven by an insertion tape to the ends of which the gripper is fixed. The insertion tape is supported and guided in its travel within the shed by a suitable guide member.

Various types of tape guide members are already known in the art.

One of these consists substantially of a continuous guide track mounted on the loom sley and extending along approximately the entire weaving width.

Such a continuous tape guide has, however the drawback that the tapes with their grippers must necessarily slide by pressing on the bed of lower warp yarns of the shed which, when the shed is open, cannot do anything other than rest against said guide, resulting in sometimes undesirable contact. Again, to prevent any deflection of said lower warp yarns of the shed about that edge of the continuous guide on the reed side being able to damage the yarns by rubbing caused by the movement of the sley and hence of said guide, a further member has to be used for supporting said warp yarns in order to prevent said contact.

Said drawbacks are eliminated in another known type of tape guide member, consisting substantially of a plurality of guide teeth fixed spaced apart on said loom sley in such a manner that the two sides of each tape can slide within guide grooves formed by said teeth.

With this latter guide the teeth can freely pass through the lower warp yarns of the shed and hence support the tapes and their grippers without these coming into contact with said warp yarns. However, this type of guide member also has drawbacks, the main one of which is that it does not allow relative movement between the gripper tape and the guide teeth in the direction of the warp yarns so that, specifically in a loom in which the tape drive wheels are mounted on the fixed loom frame and hence do not move with the sley, it is absolutely impossible to move said sley when tapes are still cooperating with the guide grooves of said teeth, this however being essential in modern looms to achieve ever increasing operating speeds. A further drawback is the possibility that, during movement, the grooves of said guide teeth can engage both the warp and weft yarns, with their consequent deterioration or breakage.

It is sought to remedy these latter drawbacks by another type of tape guide member which, although consisting of a plurality of guide teeth fixed spaced apart on the loom sley and extending through the lower warp yarns of the shed when said shed is open, slidingly supports said tapes not by means of grooves but by means of uninterrupted flat upper surfaces provided at the summit of said teeth, which extend parallel to the lower warp yarns of said shed.

In this case there is evidently no further danger of engaging the weft and/or warp yarns and moreover said flat support surfaces, which extend parallel to the lower warp yarns of the shed, enable the guide teeth to move relative to the gripper tapes in the direction of the warp yarns, hence enabling the sley, which is rigid with said teeth, to move when the tapes are still resting on said flat surface of the teeth.

This latter relative movement is, however, accompanied by a change in the guiding conditions of the tapes in that the rotation of the sley and consequently of the flat support surfaces of said guide teeth means that said surfaces are not parallel to the tapes, so that the contact regions between said surfaces and the tapes are considerably reduced, with a consequent increase in the wear of the tapes and of the guide teeth, and in addition, during the stage in which said surfaces assume positions of continuously decreasing distance from the theoretical side plane of said tapes, said surfaces generate deleterious thrusts upwards on said tapes, with consequent increase in their wear.

A further drawback of the tape guide system comprising a plurality of teeth with flat upper surfaces is the fact that the warp yarns which remain arranged obliquely on said flat surfaces of the teeth are inevitably damaged or broken by the tape or by the relative gripper.

Finally, a further drawback is a lack of an effective tape guide for insuring optimum operation in the case of looms with a large weaving width.

SUMMARY OF THE INVENTION

The object of the present invention is to obviate said drawbacks by providing a guide system for the gripper insertion tape in a shuttleless loom which, without affecting the guiding conditions for said tape, enables the loom sley to be moved even when the tape is still cooperating with its guide mounted on the sley, while allowing effective self-positioning of the lower warp yarns of the shed, and achieving effective guiding of said tape within said shed.

This is substantially attained by using a plurality of guide teeth fixed spaced apart on the loom sley and provided at an upper portion thereof convex surface for bearing and guiding the tape and the relative gripper and extending in the direction of the warp yarns. In this manner the convex shape of said tooth surface not only ensures by virtue of its curvature that warp yarns cannot be positioned obliquely on the tooth in that such yarns would slide along the curvature of the surface to position themselves in the plane of the lower warp yarns of the shed, but also allows relative movement between said tooth convex surface and the tape in the direction of the warp yarns, without problems arising.

This also evidently allows effective guiding of the tape and relative gripper with simple cooperation with the concave surfaces formed in or applied to said tape and/or gripper.

Hence the guide system for the gripper insertion tape in a shuttleless loom includes a sley with a reed, through the dents of which the upper and lower warp yarns forming the shed pass, at least one insertion tape moving with reciprocating motion between said upper and lower warp yarns of the open shed, a gripper fixed to one end of said tape to convey a weft yarn through said shed, and a plurality of guide teeth fixed spaced apart on said sley and projecting through the lower warp yarns of said shed when said shed is open, said teeth being provided with a bearing and guiding surface for said insertion tape and for said gripper, wherein according to the present invention said bearing and guiding surface of said teeth is a convex surface which extends in the direction of the warp yarns and cooperates with control means.

According to a preferred embodiment of the present invention, said convex surface of said teeth is in the form of an arc of a circle with its center coinciding with or being close to the rocking axis of said sley and its being equal to or close to the distance between the lower surface of said tape and said rocking axis of said sley.

According to a further preferred embodiment of the present invention the edges of said guide teeth are tapered.

According to another preferred embodiment of the present invention, said control means consist of the lower surface of the gripper being concave shaped.

According to a further preferred embodiment of the present invention, said control means consist of a block rigid with said gripper and comprising in its lower part a concave shaping having a generating line lying in the same plane as the lower surface of said insertion tape.

According to an additional preferred embodiment of the present invention, said control means comprises of a curvature of the gripper end of said insertion tape, which progressively decreases until reading an end of the insertion tape.

Finally, according to a further preferred embodiment of the present invention, said control means includes of a curvature of the gripper end of said insertion tape, this curvature progressively decreasing until annulled, and a block rigid with said gripper and having in its lower part a concave shaping having a generating line lying in the same plane as the lower surface of said insertion tape.

BRIEF DESCRIPTION OF THE DRAWINGS

The invention is described in detail hereinafter with reference to the accompanying drawings which illustrate a preferred embodiment thereof by way of non-limiting example in that technical or constructional modifications can be made thereto without deporting from the scope of the present invention.

In said drawings.

DESCRIPTION OF THE PREFERRED EMBODIMENT

Figure 1:
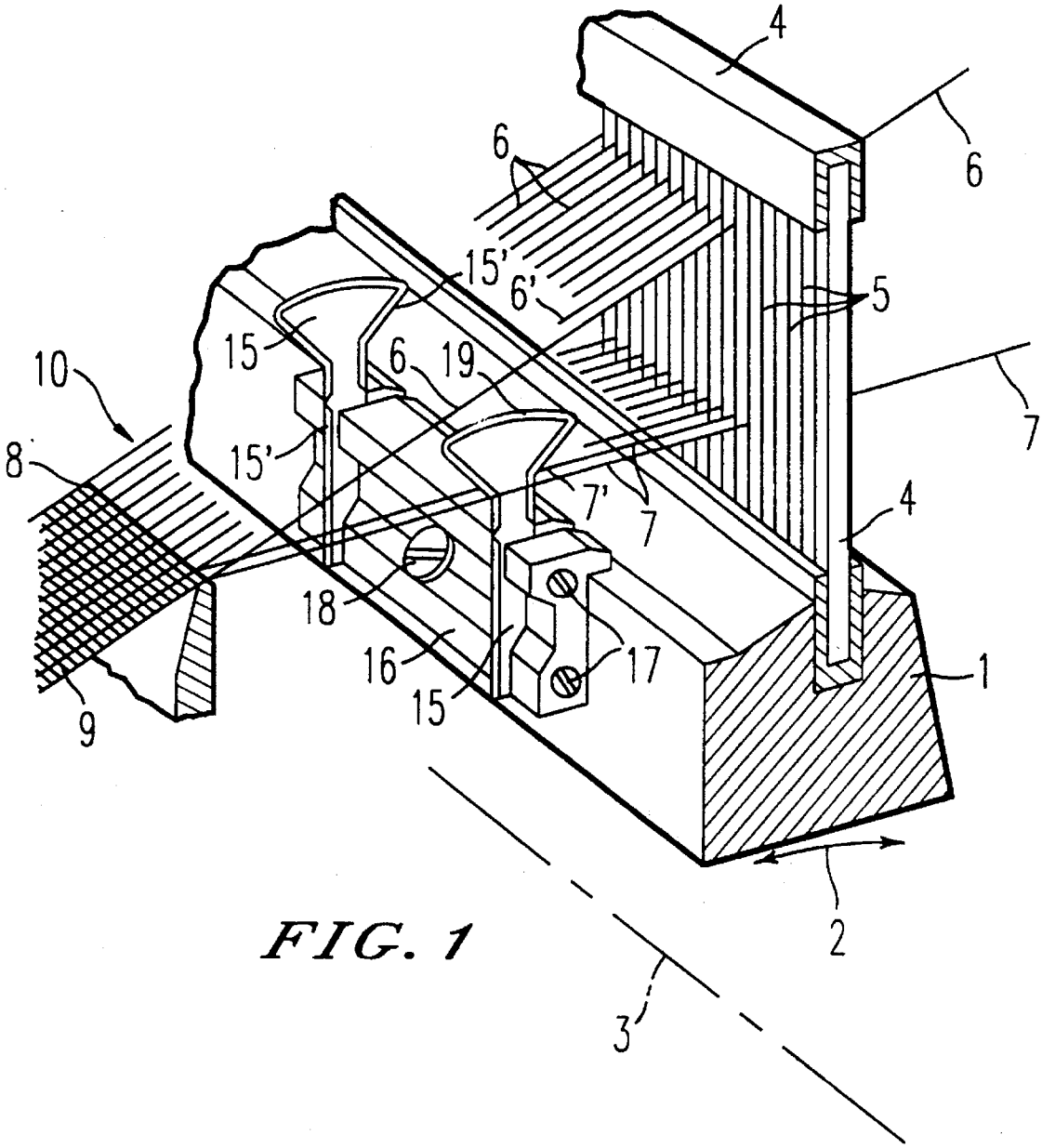
FIG. 1 is a partial perspective view of a shuttleless loom using the tape guide system of the invention, in which the tape and relative gripper are omitted for reasons of clarity.

In the figures, reference numeral 1 indicates the sley of a shuttleless loom, which, as is well known, is made to rock in the direction of the arrows 2 about the rocking axis 3 shown schematically in FIG. 1.

Figure 4:
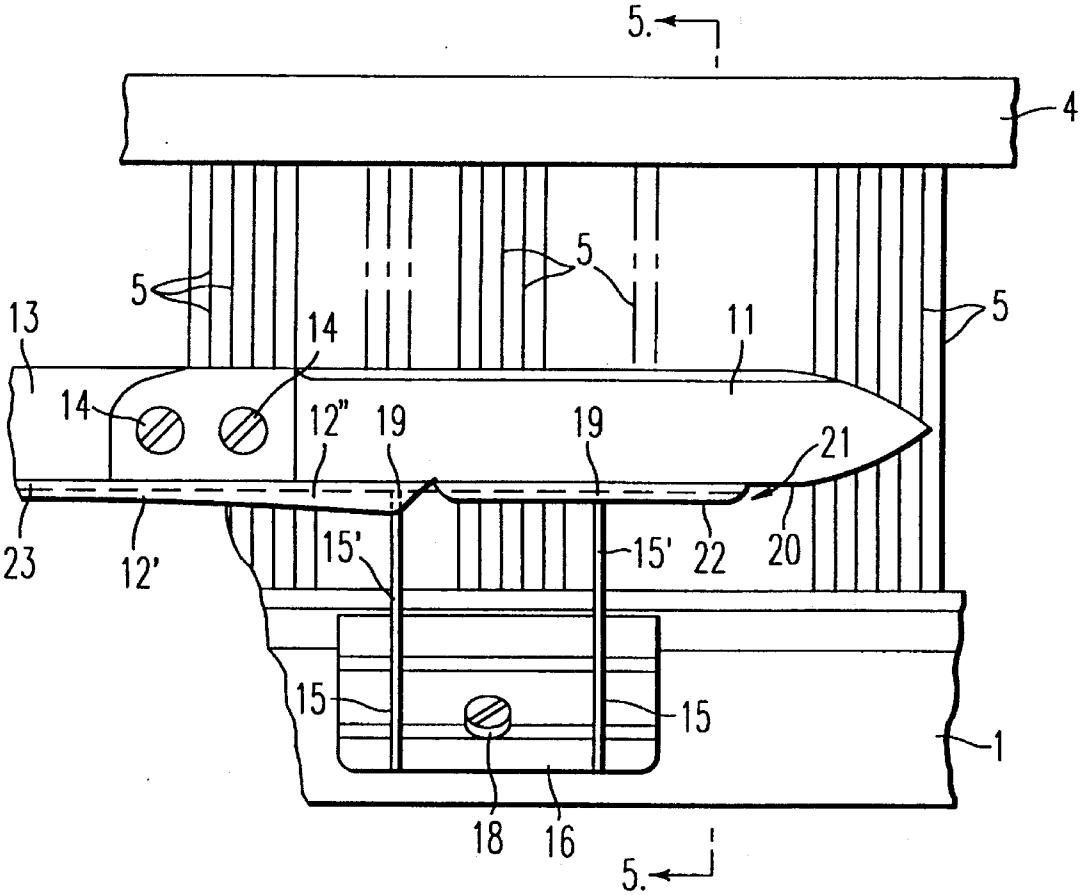
FIG. 4 is a front view of a modification of the invention.
Figure 6:
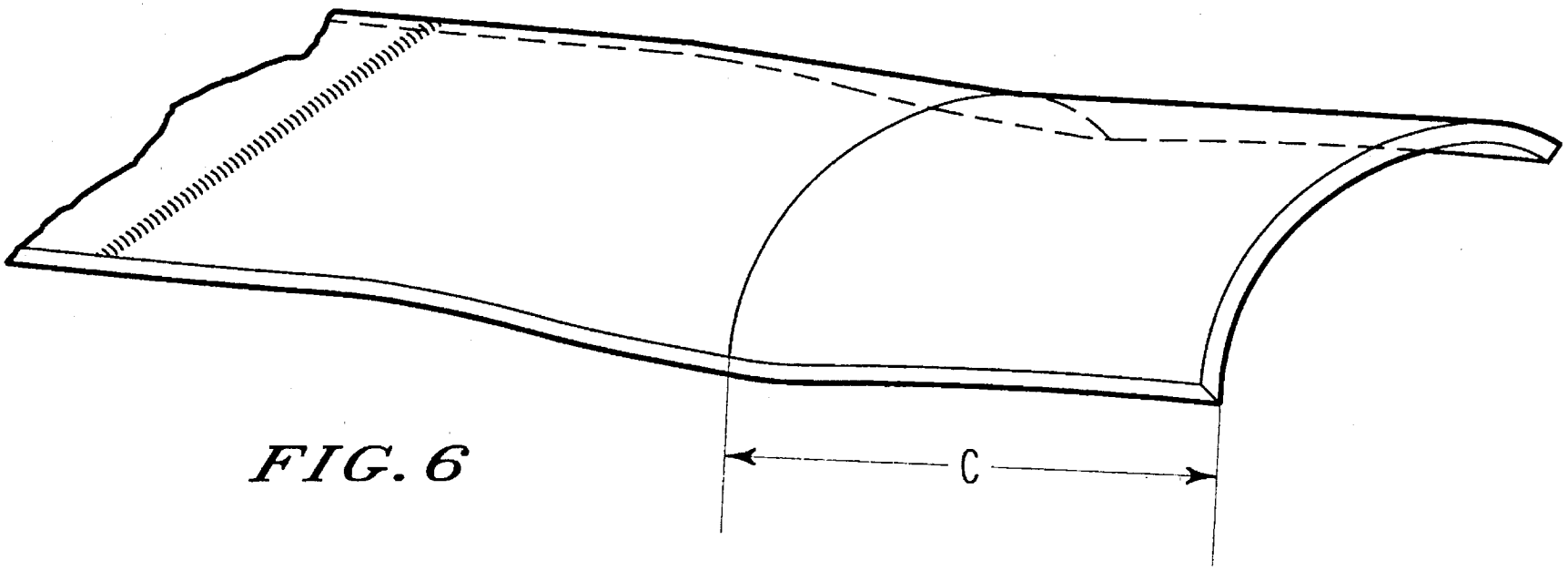
FIG. 6 shows the insertion-tape and illustrates how the curvature is variable and is discontinued near an end portion thereof.

Said sley 1 supports the reed 4, through the dents 5 of which there pass the upper warp yarns 6, 6' and the lower warp yarns 7, 7' which converge at the edge 8 of the fabric 9 under formation to form the shed 10 into which at least one gripper 11 dragging weft yarn is inserted with reciprocating movement. The reciprocating movement is transmitted to said gripper 11 by the corresponding reciprocating movement of an insertion tape 12 or 12', at the end of which there is provided a rib 13 for reinforcing the tape (see specifically FIG. 4) and for fixing the gripper 11 by screws 14. During its travel within the shed 10, said insertion tape 12 or 12' is supported by a series of teeth 15 which are fixed in pairs to said sley 1 by a fixing piece 16 which non-removably supports the two teeth by through bolts 17 and is locked to said sley 1 by a screw 18.

Figure 2:
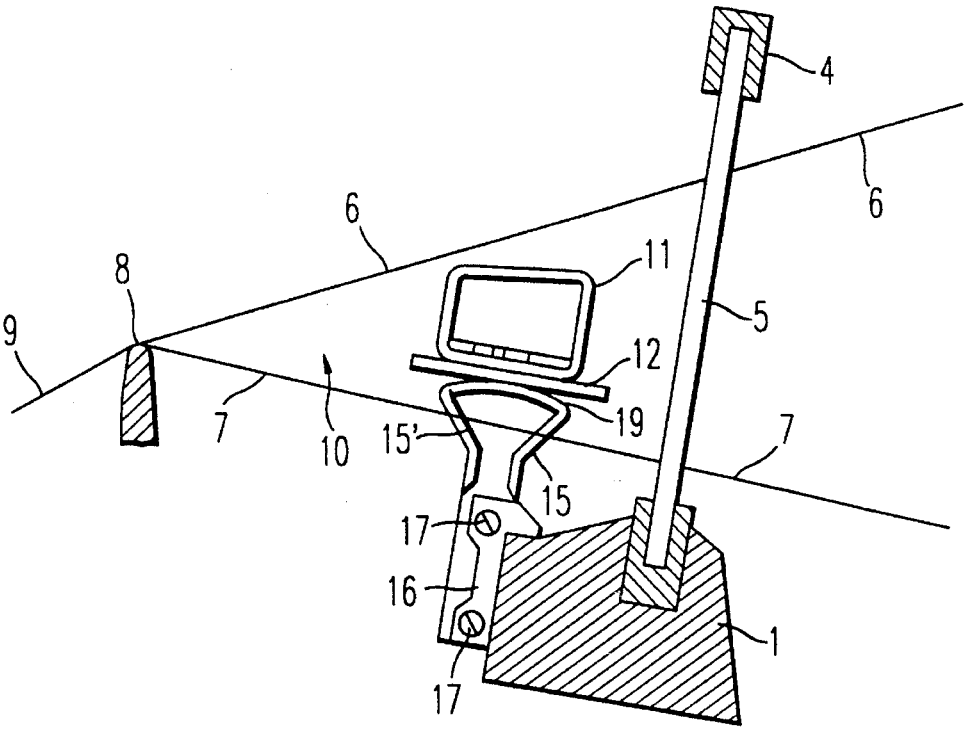
FIG. 2 is a side view of the loom of FIG. 1.
Figure 3:
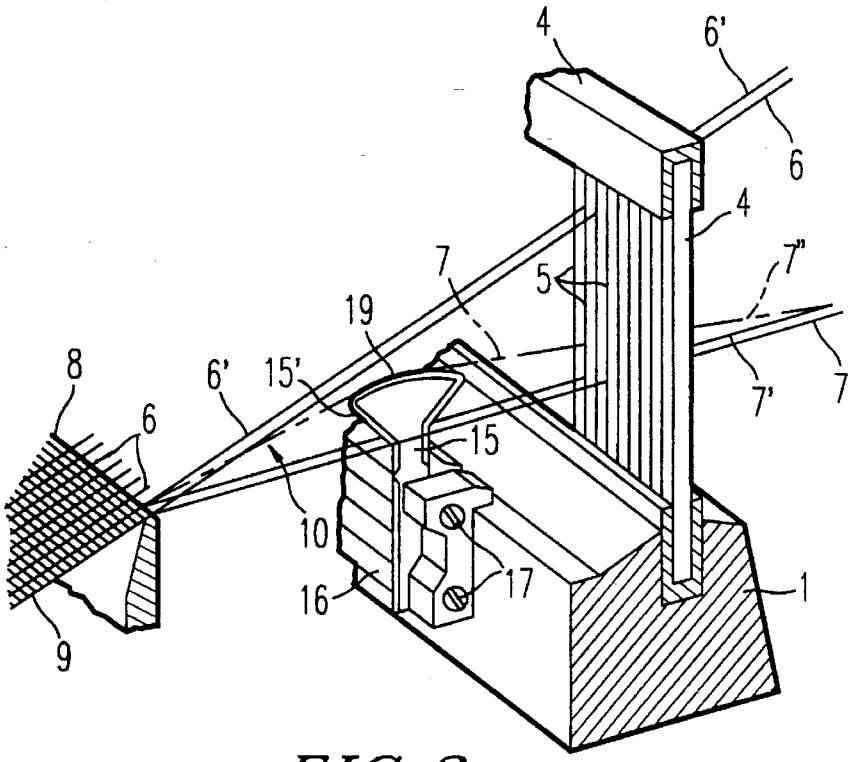
FIG. 3 is a partial perspective view of FIG. 1, showing one advantage of the tape guide system of the invention.

Each tooth 15 comprises for said insertion tape 12 or 12' a bearing and guiding surface 19 which extends in the direction of the warp yarns 6 and 7 and is convex, preferably in the form of an arc of a circle with its center on said rocking axis 3. In this manner, the tooth 15 can continue to support the tape 12 or 12' even when said tooth is not in a position symmetrical about the tape as shown in FIG. 2, but is slightly rotated from this position, this meaning that the reed-sley system can now be moved before the tape 12 and the relative gripper 11 have finished cooperating with said tooth 15. In addition the curvature of the surface 19 means that any warp yarn 7" which becomes positioned obliquely on the tooth 15 (see FIG. 3 in this respect) is compelled to slide along said curvature and assume the correct position 7', the edges 15' of the teeth 15 being tapered to further facilitate said result.

Figure 5:
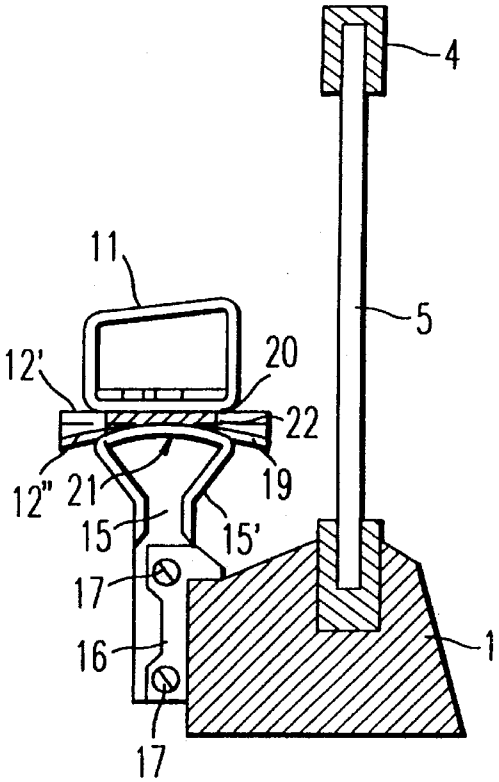
FIG. 5 is a side view on the line 5.5 of FIG. 4.

Finally, in order to make the guiding of the insertion tape 12' and of the relative gripper 11 even more effective during their travel within the shed 10, a control means or mechanism to accomplish this as provided. More particularly, the end 12" of the insertion tape 12' (see FIGS. 4 and 5) is curved downwards to form a concave surface with a curvature which decreases progressively until discontinuing at a location near an end portion of the insertion tape. The lower surface 20 of said gripper 11 is also provided with a concave shaping 21 which can either be formed directly in the gripper 11 itself or be formed in a block 22 to be fixed to said gripper. This latter concave shaping 21 is formed such that a generating line thereof is always within the plane of the lower surface 23 of the insertion tape 12'. Obviously, numerous modifications and variations of the present invention are possible in light of the above teachings. It is therefore to be understood that within the scope of the appended claims, the invention may be practiced otherwise than as specifically described herein.

We claim:

1. A guide system for gripper insertion tape in a shuttleless, loom comprising:

a sley with a reed, the reed having dents through which pass upper and lower warp yarns forming a shed, a least one insertion tape moving with reciprocating motion between said upper and lower warp yarns of the shed, a gripper fixed to one end of said tape and conveying a weft yarn through said shed, and a plurality of guide teeth fixed spaced apart on said sley and projecting through the lower warp yarns of said shed when said shed is open, said teeth being provided with a bearing and guiding surface for said insertion tape and for said gripper, wherein said bearing and guiding surface of said teeth comprises a convex surface which extends in a direction of the warp yarn; and a control mechanism making guiding of said insertion and said gripper more effective during travel thereof within the shed;

wherein said convex surface of said teeth is in the form of an arc of a circle with a center thereof coinciding with a rocking axis of said sley, the circle having a radius equal to a distance between a lower surface of said tape and said rocking axis of said sley.

2. A guide system for the gripper insertion tape in a shuttleless loom as claimed in claim 1, wherein said control mechanism comprises a lower surface of the gripper.

3. A guide system for the gripper insertion tape in a shuttleless loom as claimed in claim 1, wherein said control mechanism comprises a block rigid with said gripper and including in a lower part thereof a concave shaping having a generating line lying in the same plane as a lower surface of said insertion tape.

4. A guide system for the gripper insertion tape in a shuttleless loom as claimed in claim 1, wherein said control mechanism comprises a curvature of a gripper end portion of said insertion tape, wherein the curvature of said gripper end portion of said insertion tape progressively decreases until reaching an end of the insertion tape.

5. A guide system for the gripper insertion tape in a shuttleless loom as claimed in claim 1, wherein said control mechanism comprises a curvature of the gripper end of said insertion tape, said curvature progressively decreasing until reaching an end of the insertion tape and a block rigid with said gripper, said insertion tape being in a lower part thereof concavely shaped and having a generating line lying in the same plane as a lower surface of said insertion tape.

6. A guide system for the gripper insertion tape in a shuttleless loom as claimed in claim 1, wherein said guide teeth have tapered edges.

* * * * *